US007839235B2

(12) United States Patent
Xiong et al.

(10) Patent No.: US 7,839,235 B2
(45) Date of Patent: Nov. 23, 2010

(54) FEED NETWORK DEVICE, ANTENNA FEEDER SUBSYSTEM, AND BASE STATION SYSTEM

(75) Inventors: Xianzhi Xiong, Shenzhen (CN); Wenxin Yuan, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 110 days.

(21) Appl. No.: 12/126,564

(22) Filed: May 23, 2008

(65) Prior Publication Data

US 2008/0291110 A1 Nov. 27, 2008

(30) Foreign Application Priority Data

May 24, 2007 (CN) ..... 2007 1 0107679
Apr. 24, 2008 (WO) ..... PCT/CN2008/070793

(51) Int. Cl.
*H01P 5/18* (2006.01)
*H01P 1/18* (2006.01)
*H01P 5/12* (2006.01)

(52) U.S. Cl. ..... 333/116; 333/117

(58) Field of Classification Search ..... 333/109, 333/110, 111, 112, 115, 116, 117, 118, 132, 333/136; 342/373
See application file for complete search history.

(56) References Cited

U.S. PATENT DOCUMENTS 3,295,134 A * 12/1966 Lowe ..... 342/368
3,731,217 A * 5/1973 Gerst et al. ..... 330/56
4,989,011 A * 1/1991 Rosen et al. ..... 342/373
5,115,248 A * 5/1992 Roederer ..... 342/373
5,793,338 A 8/1998 Standke et al.
6,788,272 B2 9/2004 McCarthy et al.
6,965,279 B2 * 11/2005 Carson ..... 333/116
2005/0035825 A1 2/2005 Carson
2005/0122185 A1 6/2005 Podell
2006/0028295 A1 2/2006 Piernas

FOREIGN PATENT DOCUMENTS

CN 1166238 A 11/1997
CN 2387637 Y 7/2000
CN 1540903 A 10/2004
CN 1553725 A 12/2004
CN 1567648 A 1/2005
CN 1898877 A 1/2007
CN 1968461 A 5/2007
EP 0313057 A2 4/1989

(Continued)

OTHER PUBLICATIONS

International Search Report for International Patent Application No. PCT/CN2008/070793, dated Aug. 7, 2008, and English translation thereof.

(Continued)

*Primary Examiner*—Dean O Takaoka

(57) ABSTRACT

A feed network device, an antenna feeder subsystem, and a base station system are provided. The feed network device comprises: two first stage couplers, two phase shifters, and two second stage couplers cascaded on a Printed Circuit Board, wherein each coupler is a multilayered dielectric broad-side coupler, and the difference of phase between an output signal at the coupling port and an output signal at the direct connection port is 90° in each multi-dielectric broad-side coupler.

17 Claims, 6 Drawing Sheets

FOREIGN PATENT DOCUMENTS

| | | | |
|---|---|---|---|
| EP | 0671776 | A1 | 9/1995 |
| GB | 2158649 | A | 11/1985 |

OTHER PUBLICATIONS

European Search Report for European Patent Application No. 08009515.1, dated Oct. 1, 2008.

Chinese Office Action for Chinese Patent Application No. 2007101076794, dated Jul. 3, 2009, with English translation thereof.

English translation of the Written Opinion of the International Searching Authority for International Application No. PCT/CN2008/070793, dated Aug. 7, 2008.

* cited by examiner

FEED NETWORK DEVICE, ANTENNA FEEDER SUBSYSTEM, AND BASE STATION SYSTEM

CROSS-REFERENCE TO RELATED APPLICATIONS

This application claims the benefit of Chinese Application No. 200710107679.4, filed May 24, 2007, and International Application No. PCT/CN2008/070793, filed Apr. 24, 2008. The disclosures of the above applications are incorporated herein by reference.

FIELD

The present disclosure relates to the field of communications and to a feed network device, an antenna feeder subsystem, and a base station system.

BACKGROUND

The statements in this section merely provide background information related to the present disclosure and may not constitute prior art.

As one of the core techniques of Third Generation (3G) mobile communication, intelligent antenna technique can be used to produce a spatially directed wave beam according to the difference in signal space characteristic between mobile subscribers, so as to align the main lobe of antenna to the direction of arrival of subscriber signals and align the side lobe to the direction of arrival of interference signals, and thereby attain the purpose of utilizing mobile subscriber signals efficiently and eliminating or suppressing interference signals, improve efficiency of radio spectrum utilization and signal transmission, and utilize limited channel resource as far as possible. Compared to non-directional antennas, directional antennas can increase antenna gain in uplink and downlink greatly, reduce transmitted power level, improve Signal-to-Noise Ratio (SNR), and effectively overcome channel fading. In addition, since the antenna points to the subscribers directly, the interference between subscribers in the cell and between subscribers in adjacent cells is reduced, and the multipath effect is reduced.

To produce a spatially directed wave beam with intelligent antenna, a feed network device (i.e., beam shaping network) is required. As shown in FIG. 1, the feed network device is a main component of the antenna feeder subsystem in the base station system in 3G mobile communication system; the antenna feeder subsystem is connected to a duplexer in the base station system, and includes a feed network device, a power divider, and an antenna array, which are connected in sequence. A signal beam emitted from the Transmitter (TX) in the base station system is shaped and then transmitted to an antenna array, and a feed is provided to the array antenna unit, so that the antennae produce a plurality of separate spatially directed beams, and thereby afford good orientation to the superimposed electromagnetic wave. By guiding a radio signal to a specified subscriber direction, the subscriber can transmit and receive a signal in a limited directional area, and therefore the communication coverage and system capacity can be increased greatly, the spectrum utilization can be improved, the emission power in the base station can be reduced, the system cost can be reduced, and the interference between signals and the pollution of the electromagnetic environment can be reduced. In addition, since the Receiver (RX) also employs a plurality of separate antennae, the receiving sensitivity in an expected direction can be enhanced, and the signals in an unexpected direction can be suppressed.

In the prior art, a Butler matrix structure is usually used to implement a feed network device; Butler matrix structure is a passive and interchangeable circuit, which includes several couplers and phase shifting components, wherein, the couplers are two-input and two-output passive devices.

In the prior art, a feed network device that provides equal-amplitude output is implemented with 3 dB branch line directional couplers in standard Butler matrix topology structure; the feed network device is mainly composed of four 3 dB branch line directional couplers and two 45° phase shifters cascaded on a Printed Circuit Board (PCB). A 3 dB branch line directional coupler is a coupler that provides equal-amplitude output, and a signal at the input port becomes two output signals with an amplitude equal to half of the amplitude of the input signal after passing through the 3 dB branch line directional coupler.

FIG. 2 shows the topological structure of a feed network device implemented with 3 dB branch line directional couplers, wherein, the output pin1 of the 3 dB branch line directional coupler 201 is connected to the input pin3 of the 3 dB branch line directional coupler 202 via the 45° phase shifter 205, the output pin2 of the 3 dB branch line directional coupler 201 is directly connected to the input pin4 of the 3 dB branch line directional coupler 203, the 3 dB directional coupler 204, the 45° phase shifter 206, and the other two 3 dB branch line directional couplers are connected in a similar way.

After a signal enters the input pin Input1 of the 3 dB branch line directional coupler 201, a part of the signal is output from pin1 at the coupling port into the 45° phase shifter 205, and then is output from the input pin3 of the 3 dB branch line directional coupler 202 into the 3 dB branch line directional coupler 202, and is output from the pins Output1 and Output3 after passing through the 3 dB branch line directional coupler 202, respectively; the other part of the signal passed through the 3 dB branch line directional coupler 201 is output from the direct connection pin2 of the 3 dB branch line directional coupler 201 into pin4 of the 3 dB branch line directional coupler 203 directly, and is output from pins Output2 and Output4 after passing through the 3 dB branch line directional coupler 203.

Since two stages of 3 dB branch line directional couplers are used, after the signal is output at equal amplitude from the first coupler stage, the signals entering into the second coupler stage are output at equal amplitude further. Therefore, the feed network device can be used to divide equally the signal power input from any input port into four outputs at the output port.

Typical feed network devices with equal-amplitude output are implemented with branch line directional couplers in the prior art, a main line and a branch line of a branch line directional coupler are arranged in a surface layer of the PCB respectively, with air as a dielectric at one side and PCB material as a dielectric at the other side; therefore, the dielectric constant at the main line side is different to the dielectric constant at the branch line side, which causes poor electrical performance of the feed network device.

SUMMARY

The present disclosure provides a feed network device, an antenna feeder subsystem, and a base station system, which can improve the electrical performance of existing feed network devices.

A feed network device includes two first stage couplers, two phase shifters, and two second stage couplers that are cascaded on a PCB, wherein each first stage couplers and second stage couplers is a multilayered dielectric broad-side coupler, and the difference of phase between an output signal at the coupling port and an output signal at the direct connection port is 90° in each multilayered dielectric broad-side coupler.

A antenna feeder subsystem includes a feed network device, a power divider, and an antenna array, which are connected in sequence; wherein, the feed network device is the feed network device described above.

A base station system includes a duplexer and an antenna feeder subsystem connected to the duplexer, wherein, the antenna feeder subsystem includes a feed network device, a power divider, and an antenna array connected in sequence; wherein the feed network device is the feed network device described above.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

In various embodiments, a feed network device to shape an array antenna wave beam is provided, which is composed of two stages of multilayered dielectric broad-side couplers and two phase shifters which are cascaded on a PCB, wherein, each stage includes two identical multilayered dielectric broad-side couplers, each of which is arranged in a PCB and PCB material is utilized as the dielectric; therefore, the dielectric constants at the two sides of each multilayered dielectric broad-side coupler are identical to each other, and thereby the overall electrical performance of the feed network device is improved.

Figure 1:
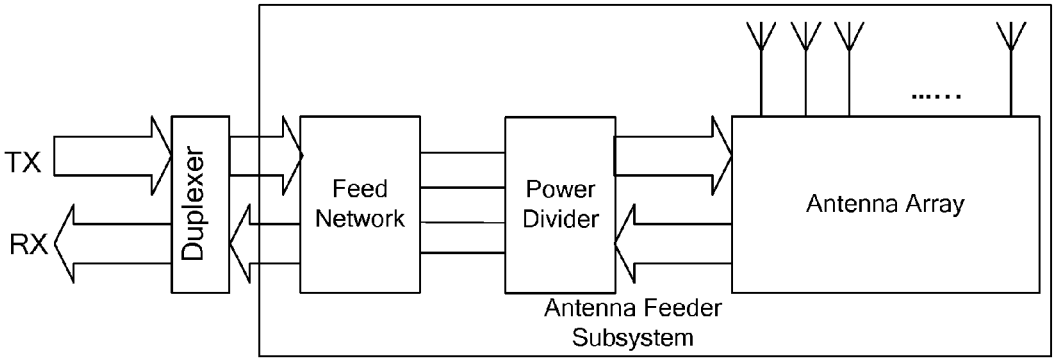
Fig. 1 Prior Art
FIG. 1 is a schematic diagram of the position of a feed network device in an existing base station system.
Figure 2:
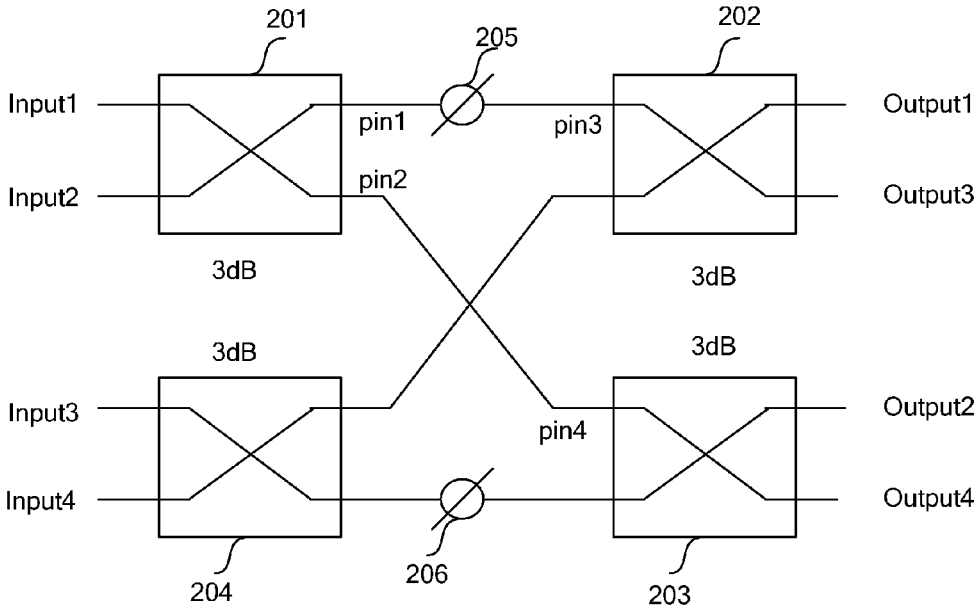
Fig. 2 Prior Art
FIG. 2 shows the topological structure of a feed network device implemented with 3 dB branch line directional couplers in the prior art.
Figure 3:
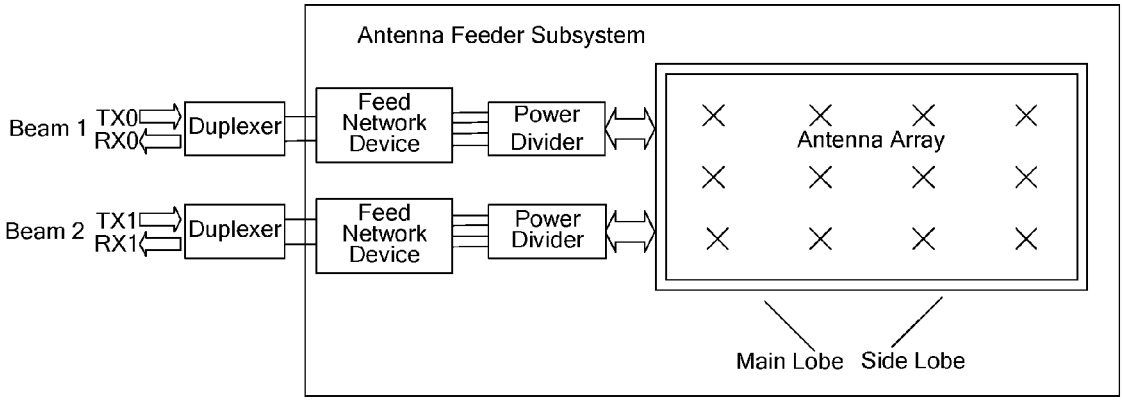
FIG. 3 is a schematic diagram of the position of a feed network device described in the various embodiments of the present disclosure in a base station system.

As shown in FIG. 3, the feed network device provided in various embodiments is a main component of an antenna feeder subsystem; the antenna feeder subsystem includes a feed network device, a power divider, and an antenna array, which are connected in sequence, wherein, the feed network device is connected between the duplexer and the power divider, and two groups of identical feed network devices can be used in the base station system to shape the main and diversity signals and then feed the shaped signals to the array antenna through the power divider. If all of the multilayered dielectric broad-side couplers are multilayered dielectric broad-side couplers with equal-amplitude output, such as 3 dB multilayered dielectric broad-side couplers, any input signal at the input port can be output at equal amplitude; in case the coupling degree of the two multilayered dielectric broad-side couplers in the first stage is adjusted to change the two multilayered dielectric broad-side couplers in the first stage into a multilayered dielectric broad-side couplers that provide unequal-amplitude output, any input signal can be output at unequal amplitude as required. Since the phase of an output signal at a coupling port of a multilayered dielectric broad-side coupler leads the phase of an output signal at a direct connection port by 90°, in conjunction with a 45° or 90° phase shifter, the phases of the signals at the four output ports of the feed network can be different to each other by 45° or 90° in sequence.

The present disclosure will be further detailed below by way of various embodiments, with reference to the accompanying drawings.

Figure 4:
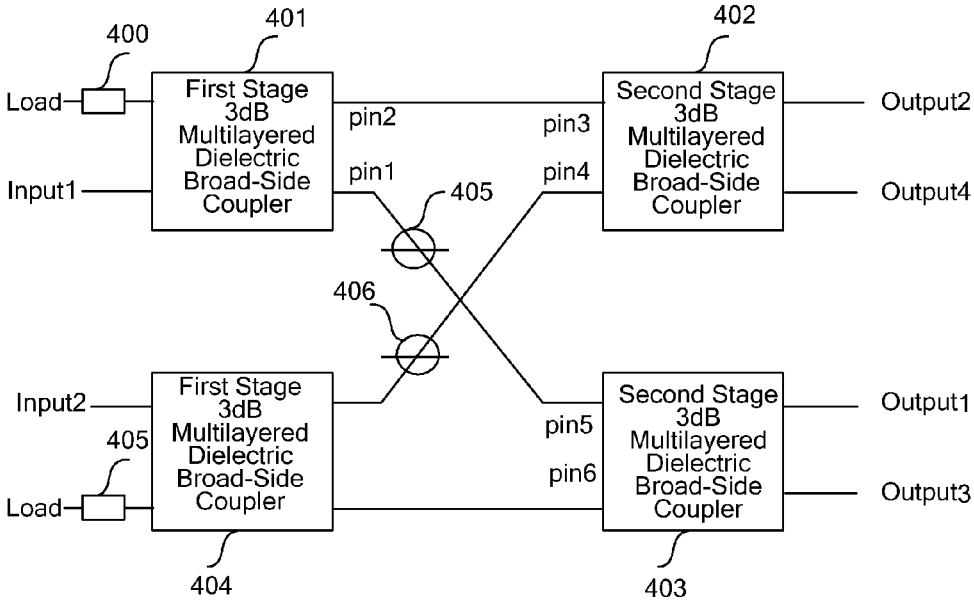
FIG. 4 is a schematic diagram of the topological structure of the feed network device according to various embodiments.

As shown in FIG. 4, the feed network device provided by various embodiments includes four 3 dB multilayered dielectric broad-side couplers (401, 402, 403, and 404) and two 45° phase shifters (405 and 406); two 3 dB multilayered dielectric broad-side couplers (401 and 404) form the first stage of 3 dB multilayered dielectric broad-side couplers, the other two 3 dB multilayered dielectric broad-side couplers (402 and 403) form the second stage of 3 dB multilayered dielectric broad-side couplers, and the two 45° phase shifters (405 and 406) are connected between the two stages of 3 dB multilayered dielectric broad-side couplers and form a passive interchangeable circuit structure. The connection is:

An input port of the 3 dB multilayered dielectric broad-side coupler 401 in the first stage is a Load port, which can be connected with a 50Ω matched load resistance 400; the other port of the 3 dB multilayered dielectric broad-side coupler 401 serves as the first input port Input 1; the coupling port pin1 of the 3 dB multilayered dielectric broad-side coupler 401 in the first stage is connected to the input pin5 of the 3 dB multilayered dielectric broad-side coupler 403 in the second stage via the 45° phase shifter 405; the direct connection port pin2 of the 3 dB multilayered dielectric broad-side coupler 401 in the first stage is directly connected to the input pin3 of the 3 dB multilayered dielectric broad-side coupler 402 in the second stage;

The 3 dB multilayered dielectric broad-side coupler 404 in the first stage is connected in a similar way as the multilayered dielectric broad-side coupler 401, wherein, an input port serves as the Load port and can be connected with a 50Ω matched load resistance 405, the other port serves as the second input port Input2, the direct connection port is directly connected to the input pin6 of the 3 dB multilayered dielectric broad-side coupler 403 in the second stage, and the coupling port is connected to the input pin4 of the 3 dB multilayered dielectric broad-side coupler 402 in the second stage via the 45° phase shifter 406;

The four output ports Output2, Output4, Output1, and Output3 of the two 3 dB multilayered dielectric broad-side couplers in the second stage are four signal output ports.

Hereinafter, illustration will be given, by way of a non-limiting example, a signal input from the first input port Input1 is output at equal amplitude:

After being input into the 3 dB multilayered dielectric broad-side coupler 401 in the first stage from Input1, a signal is output as signals at equal amplitude, the signal output from the coupling port pin1 passes through the 45° phase shifter into the pin5 of the 3 dB multilayered dielectric broad-side coupler 403 in the second stage, and then is output at equal amplitude from the coupling port Output1 and the direct connection port Output3 of the 3 dB multilayered dielectric broad-side coupler 403 in the second stage; the signal output from the direct connection port pin2 directly enters the pin3 of the 3 dB multilayered dielectric broad-side coupler 402 in the second stage, and then is output at equal amplitude from the coupling port Output2 and the direct connection port Output4 of the 3 dB multilayered dielectric broad-side coupler 402 in the second stage.

Since all the multilayered dielectric broad-side couplers in the two stages are 3 dB multilayered dielectric broad-side couplers, a input signal is distributed to the four output ports and output at equal amplitude respectively; Due to the effect of the 45° phase shifters and the characteristic that the phase of an output signal at the coupling port of multilayered dielectric broad-side coupler leads the phase of an output signal at the direct connection port by 90°, the phase of a signal output from the output port Output2 lags the phase of a signal output from the output port Output1 by 45°, the phase of a signal output from the output port Output3 lags the phase of a signal output from the output port Output2 by 45°, and the phase of a signal output from the output port Output4 lags the phase of a signal output from the output port Output3 by 45°.

Likewise, when the signal is input from Input2, the input signal is distributed to the four output ports and output at equal amplitude, the phase of a signal output from the output port Output2 leads the phase of a signal output from the output port Output1 by 45°, the phase of a signal output from the output port Output3 leads the phase of a signal output from the output port Output2 by 45°, and the phase of a signal output from the output port Output4 leads the phase of a signal output from the output port Output3 by 45°.

Figure 5:
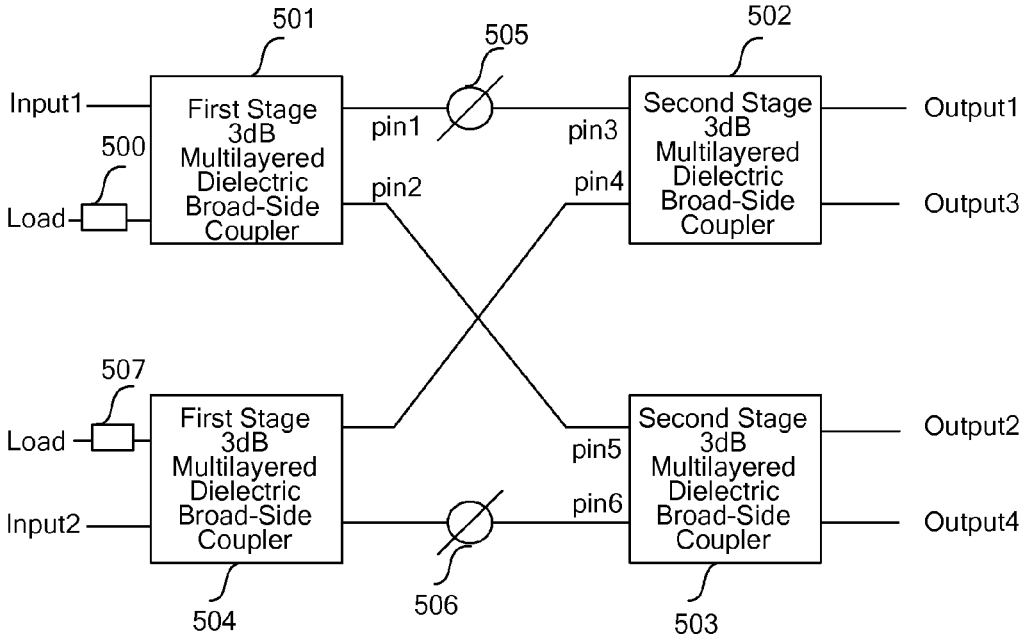
FIG. 5 is a schematic diagram of the topological structure of the feed network device according to various embodiments.

As shown in FIG. 5, the feed network device provided by various embodiments includes four 3 dB multilayered dielectric broad-side couplers (501, 502, 503, and 504) and two 45° phase shifters (505 and 506); two 3 dB multilayered dielectric broad-side couplers (501 and 504) form the first stage of 3 dB multilayered dielectric broad-side couplers, the other two 3 dB multilayered dielectric broad-side couplers (502 and 503) form the second stage of 3 dB multilayered dielectric broad-side couplers, and the two 45° phase shifters (505 and 506) are connected between the two stages of 3 dB multilayered dielectric broad-side couplers and form a passive interchangeable circuit structure. The connection is:

An input port of the 3 dB multilayered dielectric broad-side coupler 501 in the first stage is a Load port, which can be connected with a 50Ω matched load resistance 500; the other port of the 3 dB multilayered dielectric broad-side coupler 501 serves as the first input port Input1; the coupling port pin1 of the 3 dB multilayered dielectric broad-side coupler 501 in the first stage is connected to the input pin3 of the 3 dB multilayered dielectric broad-side coupler in the second stage via the 45° phase shifter 505; the direct connection port pin2 of the 3 dB multilayered dielectric broad-side coupler 501 in the first stage is directly connected to the input pin5 of the 3 dB multilayered dielectric broad-side coupler 503 in the second stage;

The 3 dB multilayered dielectric broad-side coupler 504 in the first stage is connected in the same way as the multilayered dielectric broad-side coupler 501, wherein, an input port serves as a Load port and can be connected with a 50Ω matched load resistance 507, the other port serves as the second input port Input2, the direct connection port is directly connected to the input pin4 of the 3 dB multilayered dielectric broad-side coupler 502 in the second stage, and the coupling port is connected to the input pin6 of the 3 dB multilayered dielectric broad-side coupler 503 in the second stage via the 45° phase shifter 506;

The four output ports Output1, Output2, Output3, and Output4 of the two 3 dB multilayered dielectric broad-side couplers in the second stage are four signal output ports.

Hereinafter, illustration will be given, by way of a non-limiting example, a signal input from the first input port Input1 is output at equal amplitude:

After being input into the 3 dB multilayered dielectric broad-side coupler 501 in the first stage from Input1, a signal is output as signals at equal amplitude, wherein, the signal output from the coupling port pin1 passes through the 45° phase shifter 505 into the pin3 of the 3 dB multilayered dielectric broad-side coupler 502 in the second stage, and then is output from Output1 and Output3 at equal amplitude; the signal output from the direct connection port pin2 directly enters the pin5 of the 3 dB multilayered dielectric broad-side coupler 503 in the second stage, and then is output from Output2 and Output4 at equal amplitude.

Since all the multilayered dielectric broad-side couplers in the two stages are 3 dB multilayered dielectric broad-side couplers, a input signal is distributed to the four output ports and output at equal amplitude respectively; Due to the effect of the 45° phase shifters and the characteristic that the phase of an output signal at the coupling port of multilayered dielectric broad-side coupler leads the phase of an output signal at the direct connection port by 90°, the phase of a signal output from the output port Output2 lags the phase of a signal output from the output port Output1 by 45°, the phase of a signal output from the output port Output3 lags the phase of a signal output from the output port Output2 by 45°, and the phase of a signal output from the output port Output4 lags the phase of a signal output from the output port Output3 by 45°.

Likewise, when the signal is input from Input2, the input signal is distributed to the four output ports and output at equal amplitude, the phase of a signal output from the output port Output2 leads the phase of a signal output from the output port Output1 by 45°, the phase of a signal output from the output port Output3 leads the phase of a signal output from the output port Output2 by 45°, and the phase of a signal output from the output port Output4 leads the phase of a signal output from the output port Output3 by 45°.

Figure 6:
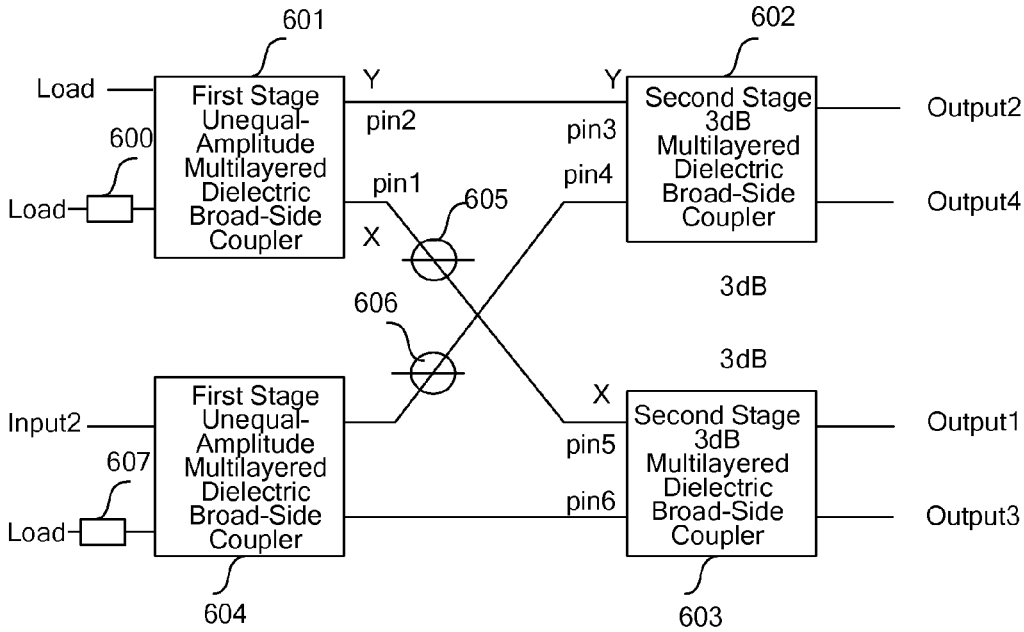
FIG. 6 is a schematic diagram of the topological structure of the feed network device according to various embodiments.

To implement unequal-amplitude output from a input signal, by adjusting the coupling degree of the multilayered dielectric broad-side couplers, the two multilayered dielectric broad-side couplers in the first stage can be designed as multilayered dielectric broad-side couplers that provide unequal-amplitude output. The circuit structure is shown in FIG. 6, wherein, the couplers in the first stage are multilayered dielectric broad-side couplers (601 and 604) that provide unequal-amplitude output, and the couplers in the second stage are two 3 dB multilayered dielectric broad-side couplers (602 and 603); the two 45° phase shifters (605 and 606) are cascaded between the two stages of couplers. The connection is:

An input port of the multilayered dielectric broad-side coupler 601 that provides unequal-amplitude output in the first stage is a Load port, which can be connected with a 50Ω matched load resistance 600; the other port of the multilayered dielectric broad-side coupler 601 serves as the first input port Input1; the coupling port pin1 of the multilayered dielectric broad-side coupler 601 that provides unequal-amplitude output in the first stage is connected to the pin5 of the 3 dB multilayered dielectric broad-side coupler 603 in the second stage via the 45° phase shifter 605; the direct connection port pin2 of the multilayered dielectric broad-side coupler 601 that provides unequal-amplitude output in the first stage is directly connected to the pin3 of the 3 dB multilayered dielectric broad-side coupler 602 in the second stage;

The multilayered dielectric broad-side coupler 604 that provides unequal-amplitude output in the first stage is connected in a similar way as the multilayered dielectric broad-side coupler 601, wherein, one input port is a Load port and can be connected to a 50Ω matched load resistance 607, the other port serves as the second input port Input2, the coupling port of the multilayered dielectric broad-side coupler 604 that provides unequal-amplitude output in the first stage is connected to the pin4 of the 3 dB multilayered dielectric broad-side coupler 602 in the second stage via a 45° phase shifter 606, and the direct connection port of the multilayered dielectric broad-side coupler 604 that provides unequal-amplitude output in the first stage is directly connected to the pin6 of the 3 dB multilayered dielectric broad-side coupler 603 in the second stage.

The four output ports Output2, Output4, Output1, and Output3 of the two 3 dB multilayered dielectric broad-side couplers in the second stage are four signal output ports.

Hereinafter, illustration will be given, by way of a non-limiting example, a signal input from the first input port Input1 is output at unequal amplitude:

After being input into the multilayered dielectric broad-side coupler 601 that provides unequal-amplitude output in the first stage from Input1, a signal is output as signals X and Y at unequal amplitude; the signal X output from the coupling port pin1 enters the pin5 of the 3 dB multilayered dielectric broad-side coupler 603 in the second stage via the 45° phase shifter 605, and then is output from the coupling port Output1 and the direct connection port Output3 of the 3 dB multilayered dielectric broad-side coupler 603 in the second stage at equal amplitude; the signal Y output from the direct connection port pin2 enters the pin3 of the 3 dB multilayered dielectric broad-side coupler 602 in the second stage directly, and then is output from Output2 and Output4 at equal amplitude.

In that way, by the effect of the multilayered dielectric broad-side coupler that provides unequal-amplitude output in the first stage, the output signals from Output1 and Output2 are different in amplitude; meanwhile, the amplitude of the output signal from Output1 is equal to the amplitude of the output signal from Output3, and the amplitude of the output signal from Output2 is equal to the amplitude of the output signal from Output4; by adjusting the coupling degree of the multilayered dielectric broad-side coupler 601 that provides unequal-amplitude output in the first stage, the amplitude ratio between the output signals from Output2 and Output1 can be set to an expected value. By the effect of the two 45° phase shifters, and due to the characteristic that the phase of output signal from the coupling port of multilayered dielectric broad-side coupler lead the phase of output signal from the direct connection port by 90°, the phase of a signal output from the output port Output2 lags the phase of a signal output from the output port Output1 by 45°, the phase of a signal output from the output port Output3 lags the phase of a signal output from the output port Output2 by 45°, and the phase of a signal output from the output port Output4 lags the phase of a signal output from output port Output3 by 45°.

Likewise, when the signal is input from Input2, the output signal from Output1 is at the same amplitude as the output signal from Output3, and the output signal from Output2 is at the same amplitude as the output signal from Output4, the phase of a signal output from the output port Output2 leads the phase of a signal output from the output port Output1 by 45°, the phase of a signal output from the output port Output3 leads the phase of a signal output from the output port Output2 by 45°, and the phase of a signal output from the output port Output4 leads the phase of a signal output from the output port Output3 by 45°. By adjusting the coupling degree of the multilayered dielectric broad-side coupler 604 that provides unequal-amplitude output in the first stage, the amplitude ratio between the output signals from Output2 and Output1 can be set at an expected value.

Figure 7:
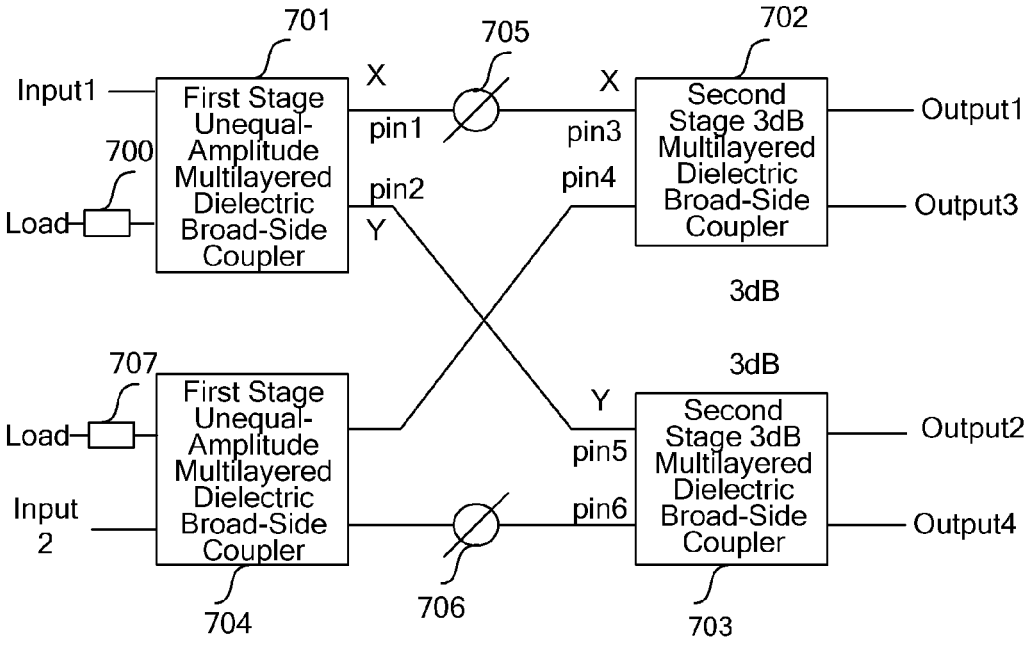
FIG. 7 is a schematic diagram of the topological structure of the feed network device according to various embodiments.

To implement unequal-amplitude output from the input signal, by adjusting the coupling degree of the multilayered dielectric broad-side couplers, the two multilayered dielectric broad-side couplers in the first stage can be designed as multilayered dielectric broad-side couplers that provide unequal-amplitude output. The circuit structure is shown in FIG. 7, wherein, the couplers in the first stage are multilayered dielectric broad-side couplers (701 and 704) that provide unequal-amplitude output, and the couplers in the second stage are two 3 dB multilayered dielectric broad-side couplers (702 and 703); the two 45° phase shifters (705 and 706) are cascaded between the two stages of couplers. The connection is:

An input port of the multilayered dielectric broad-side coupler 701 that provides unequal-amplitude output in the first stage is a Load port, which can be connected with a 50Ω matched load resistance 700; the other port of the multilayered dielectric broad-side coupler 701 serves as the first input port Input1; the coupling port pin1 of the multilayered dielectric broad-side coupler 701 that provides unequal-amplitude output in the first stage is connected to the pin3 of the 3 dB multilayered dielectric broad-side coupler 702 in the second stage via the 45° phase shifter 705; the direct connection port pin2 of the multilayered dielectric broad-side coupler 701 that provides unequal-amplitude output in the first stage is directly connected to the pin5 of the 3 dB multilayered dielectric broad-side coupler 703 in the second stage;

The multilayered dielectric broad-side coupler 704 that provides unequal-amplitude output in the first stage is connected in a similar way as the multilayered dielectric broad-side coupler 701, wherein, one input port is a Load port and can be connected to a 50Ω matched load resistance 707, and the other port serves as the second input port Input2.

The four output ports Output1, Output2, Output3, and Output4 of the two 3 dB multilayered dielectric broad-side couplers in the second stage are four signal output ports.

Hereinafter, illustration will be given, by way of a non-limiting example, a signal input from the first input port Input1 is output at unequal amplitude:

After being input into the multilayered dielectric broad-side coupler 701 that provides unequal-amplitude output in the first stage from Input1, a signal is output as signals X and Y at unequal amplitude; the signal X output from the coupling port pin1 enters the pin3 of the 3 dB multilayered dielectric broad-side coupler 702 in the second stage via the 45° phase shifter 705, and then is output from Output1 and Output3 at equal amplitude; the signal Y output from the direct connection port pin2 enters the pin5 of the 3 dB multilayered dielectric broad-side coupler 703 in the second stage directly, and then is output from Output2 and Output4 at equal amplitude.

In that way, by the effect of the multilayered dielectric broad-side coupler that provides unequal-amplitude output in the first stage, the output signals from Output1 and Output2 are different in amplitude; meanwhile, the amplitude of the output signal from Output1 is equal to the amplitude of the output signal from Output3, and the amplitude of the output signal from Output2 is equal to the amplitude of the output signal from Output4; by adjusting the coupling degree of the multilayered dielectric broad-side coupler 701, the amplitude ratio between the output signals from Output2 and Output1 can be set to an expected value. By the effect of the two 45° phase shifters, and due to the characteristic that the phase of output signal from the coupling port of multilayered dielectric broad-side coupler lead the phase of output signal from the direct connection port by 90°, the phase of a signal output from the output port Output2 lags the phase of a signal output from the output port Output1 by 45°, the phase of a signal output from the output port Output3 lags the phase of a signal output from the output port Output2 by 45°, and the phase of a signal output from the output port Output4 lags the phase of a signal output from output port Output3 by 45°.

Likewise, when the signal is input from Input2, the output signal from Output1 is at the same amplitude as the output signal from Output3, and the output signal from Output2 is at the same amplitude as the output signal from Output4, the phase of a signal output from the output port Output2 leads the phase of a signal output from the output port Output1 by 45°, the phase of a signal output from the output port Output3 leads the phase of a signal output from the output port Output2 by 45°, and the phase of a signal output from the output port Output4 leads the phase of a signal output from the output port Output3 by 45°. By adjusting the coupling degree of the multilayered dielectric broad-side coupler 704 that provides unequal-amplitude output in the first stage, the amplitude ratio between the output signals from Output2 and Output1 can be set at an expected value.

Figure 8:
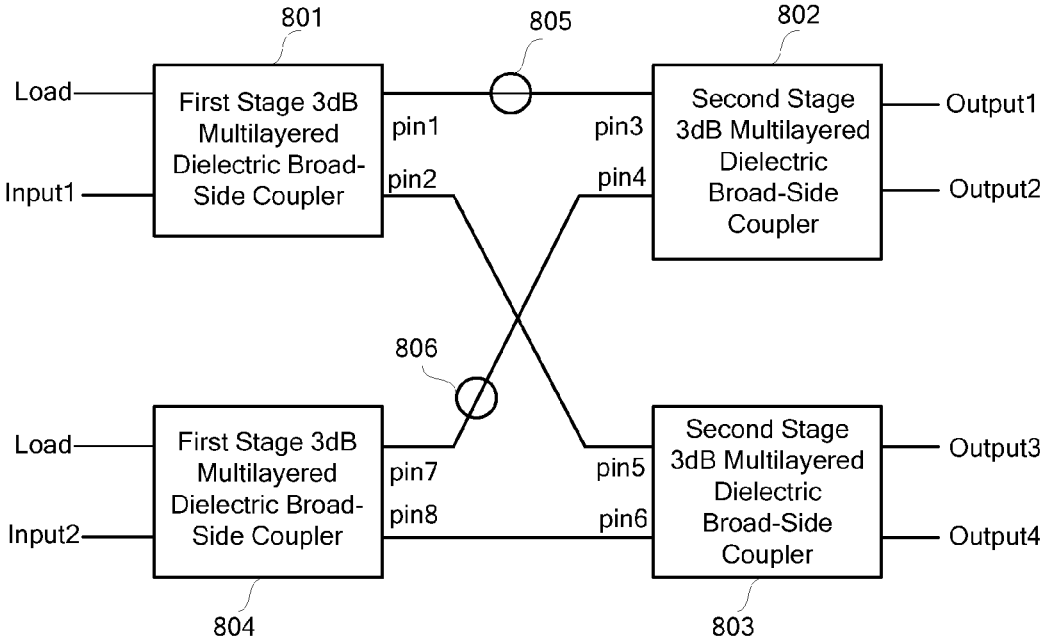
FIG. 8 is a schematic diagram of the topological structure of the feed network device according to various embodiments.

Two 90° phase shifters can be used to make that the phase of a signal output from the output port Output1 leads the phase of a signal output from the output port Output2 by 90°, the phase of a signal output from the output port Output4 leads the phase of a signal output from the output port Output1 by 90°, and the phase of a signal output from the output port Output3 leads the phase of a signal output from the output port Output4 by 90°. The structure is shown in FIG. 8. As shown in FIG. 8, the feed network device provided in the various embodiments includes four 3 dB multilayered dielectric broad-side couplers (801, 802, 803, and 804) and two 90° phase shifters (805 and 806), wherein:

The direct connection port pin1 of the 3 dB multilayered dielectric broad-side coupler 801 in the first stage is connected to the pin3 of the 3 dB multilayered dielectric broad-side coupler 802 in the second stage via the 90° phase shifter 805, the coupling port pin2 of the 3 dB multilayered dielectric broad-side coupler 801 in the first stage is directly connected to the pin5 of the 3 dB multilayered dielectric broad-side coupler 803 in the second stage;

The direct connection port pin7 of the 3 dB multilayered dielectric broad-side coupler 804 in the first stage is connected to the pin4 of the 3 dB multilayered dielectric broad-side coupler 802 in the second stage via the 90° phase shifter 806, the coupling port pin8 of the 3 dB multilayered dielectric broad-side coupler 804 in the first stage is directly connected to the pin6 of the 3 dB multilayered dielectric broad-side coupler 803 in the second stage;

Wherein, in each 3 dB multilayered dielectric broad-side coupler in the first stage, there is an input port which serves as a Load port and can be connected to a 50Ω matched load resistance; the four output ports Output1, Output2, Output3, and Output4 of the two 3 dB multilayered dielectric broad-side couplers in the second stage serve as the output ports of the feed network device in sequence.

After being input into the 3 dB multilayered dielectric broad-side coupler 801 in the first stage from Input1, a signal is output as signals at equal amplitude; the signal output from the direct connection port pin1 enters the pin3 of the 3 dB multilayered dielectric broad-side coupler 802 in the second stage via the 90° phase shifter 805, and then is output from Output1 and Output2 at equal amplitude; the signal output from the coupling port pin2 enters the pin5 of the 3 dB multilayered dielectric broad-side coupler 803 in the second stage directly, and then is output from Output3 and Output4 at equal amplitude.

After being input into the 3 dB multilayered dielectric broad-side coupler 804 in the first stage from Input2, a signal is output as signals at equal amplitude; the signal output from the coupling port pin8 enters the pin6 of the 3 dB multilayered dielectric broad-side coupler 803 in the second stage directly and then is output from Output3 and Output4 at equal amplitude; the signal output from the direct connection port pin7 passes through the 90° phase shifter 806 and enters the pin4 of the 3 dB multilayered dielectric broad-side coupler 802 in the second stage and then is output from Output1 and Output2 at equal amplitude.

Since all the multilayered dielectric broad-side couplers in the two stages are 3 dB multilayered dielectric broad-side couplers, the input signal is distributed to the four output ports and output at equal amplitude; by the effect of the 90° phase shifters, and due to the characteristic that the phase of output signal at the coupling port of multilayered dielectric broad-side coupler leads the phase of output signal at the direct connection port by 90°, the phase of a signal output from the output port Output2 lags the phase of a signal output from the output port Output1 by 90°, the phase of a signal output from the output port Output3 lags the phase of a signal output from the output port Output2 by 90°, and the phase of a signal output from the output port Output4 lags the phase of a signal output from output port Output3 by 90°.

Likewise, when the signal is input from Input2, the phase of a signal output from the output port Output2 leads the phase of a signal output from the output port Output1 by 90°, the phase of a signal output from the output port Output3 leads the phase of a signal output from the output port Output2 by 90°, and the phase of a signal output from the output port Output4 leads the phase of a signal output from the output port Output3 by 90°.

Figure 9:
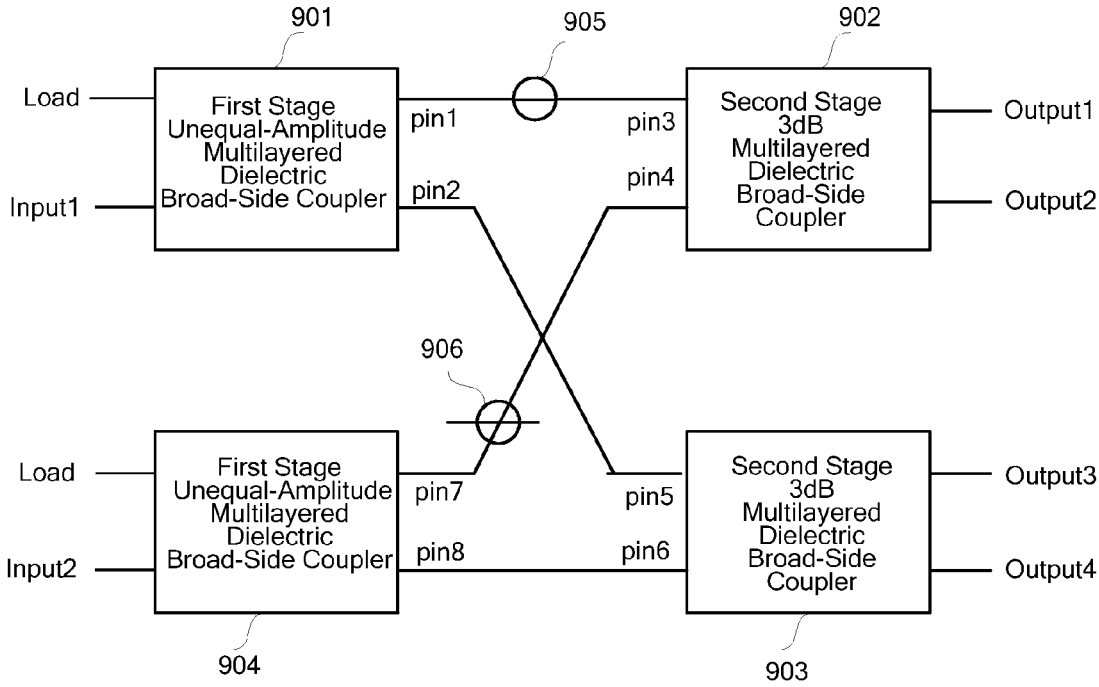
FIG. 9 is a schematic diagram of the topological structure of the feed network device according to various embodiments.

FIG. 9 is a schematic diagram of the topological structure of a feed network device that provides unequal-amplitude output, which is implemented with two 90° phase shifters; the multilayered dielectric broad-side couplers in the first stage of the feed network device include two multilayered dielectric broad-side couplers (901 and 904) that provide unequal-amplitude output, and the second stage multilayered dielectric broad-side couplers include two 3 dB multilayered dielectric broad-side couplers (902 and 903); the two 90° phase shifters (905 and 906) are cascaded between the two stages of multilayered dielectric broad-side couplers.

After being input into the multilayered dielectric broad-side coupler 901 that provides unequal-amplitude output in the first stage from Input1, a signal is output as two signals at unequal amplitude; the signal output from the direct connection port pin1 passes through the 90° phase shifter 905 and enters the pin3 of the 3 dB multilayered dielectric broad-side coupler 902 in the second stage, and then is output from Output1 and Output2 at equal amplitude; the signal output from the coupling port pin2 enters the pin5 of the 3 dB multilayered dielectric broad-side coupler 903 in the second stage directly, and then is output from Output3 and Output4 at equal amplitude.

After being input into the multilayered dielectric broad-side coupler 904 that provides unequal-amplitude output in the first stage from Input2, a signal is output as two signals at unequal amplitude; the signal output from the coupling port pin8 enters the pin6 of the 3 dB multilayered dielectric broad-side coupler 903 in the second stage directly and then is output from Output3 and Output4 with equal amplitude; the signal output from the direct connection port pin7 passes through the 90° phase shifter 906 and enters the pin4 of the 3 dB multilayered dielectric broad-side coupler 902 in the second stage and then is output from Output1 and Output2 at equal amplitude.

In that way, by the effect of the multilayered dielectric broad-side coupler that provides unequal amplitude output in the first stage, the amplitude of output signal OUT1 is equal to the amplitude of the output signal OUT2, and the amplitude of the output signal OUT3 is equal to the amplitude of the output signal OUT4; by adjusting the coupling degree of the coupler, the amplitude ratio between output signals from OUT1 and OUT3 can be set to an expected value. By the effect of the two 90° phase shifters, and due to the characteristic that the phase of output signal from the coupling port of multilayered dielectric broad-side coupler lead the phase of output signal from the direct connection port by 90°, the phase of a signal output from the output port Output2 lags the phase of a signal output from the output port Output1 by 90°, the phase of a signal output from the output port Output3 lags the phase of a signal output from the output port Output2 by 90°, and the phase of a signal output from the output port Output4 lags the phase of a signal output from output port Output3 by 90°.

Likewise, when the signal is input from Input2, the phase of a signal output from the output port Output2 leads the phase of a signal output from the output port Output1 by 90°, the phase of a signal output from the output port Output3 leads the phase of a signal output from the output port Output2 by 90°, and the phase of a signal output from the output port Output4 leads the phase of a signal output from the output port Output3 by 90°.

It is noted that the 45° and 90° phase difference values between the output ports of the feed network device are design values; the actual values may have some error within an allowable range.

Figure 10:
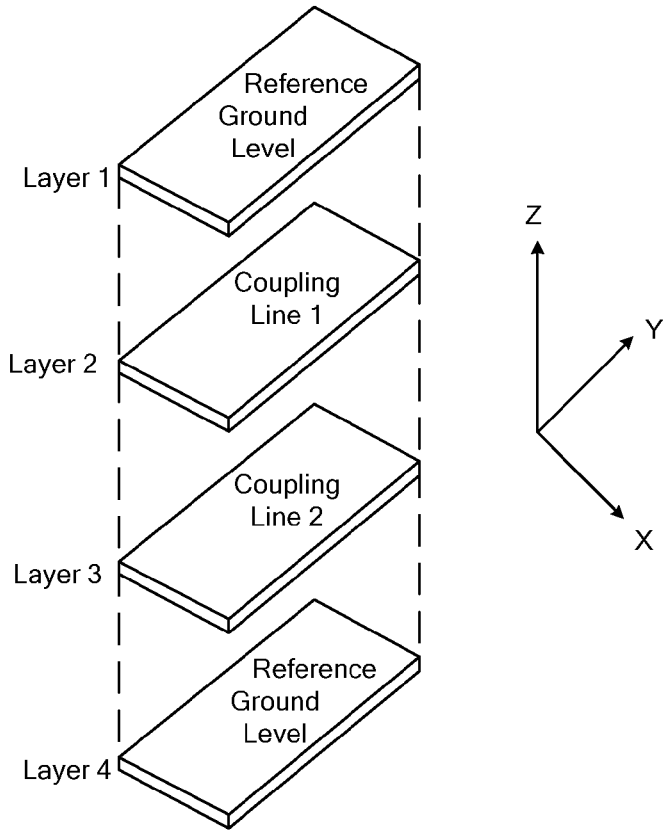
FIG. 10 is a schematic diagram of the laminated PCB structure of the feed network device according to various embodiments.

The feed network device described in the various embodiments is implemented with four layers of boards stacked on a PCB, as shown in FIG. 10. It is seen from the drawing: the top and bottom dielectric layers are a first ground layer 1 and a second ground layer 2, two broad-side coupling lines are arranged on the two intermediate layers respectively and are made of dielectric PCB material, the dielectric is distributed evenly and has the same dielectric constant.

The two broad-side coupling lines on each multilayered dielectric broad-side coupler are cross distributed in X-shape; that approach can avoid error in coupling degree caused by processing error; wherein, the two input ports are on one side of the multilayered dielectric broad-side coupler, and the two output ports are on the opposite side of the multilayered dielectric broad-side coupler. Therefore, the two signal input ports of the feed network device are distributed on the same side of the PCB, and the four output ports are on the opposite side of the PCB, so as to facilitate installation and maintenance.

On the basis of the same principle, the couplers and phase shifters in the feed network device provided in the present disclosure can be separate components, which are cascaded via the PCB; the positions of the components can be designed flexibly as required.

Hereinafter we describe how to implement multilayered dielectric broad-side couplers in which the phase of output signal from the coupling port lead the phase of output signal from the direct connection port by 90° and how to utilize emulation technique to adjust the coupling degree of the multilayered dielectric broad-side couplers in the design process so as to implement multilayered dielectric broad-side couplers that provide unequal-amplitude output.

Figure 11:
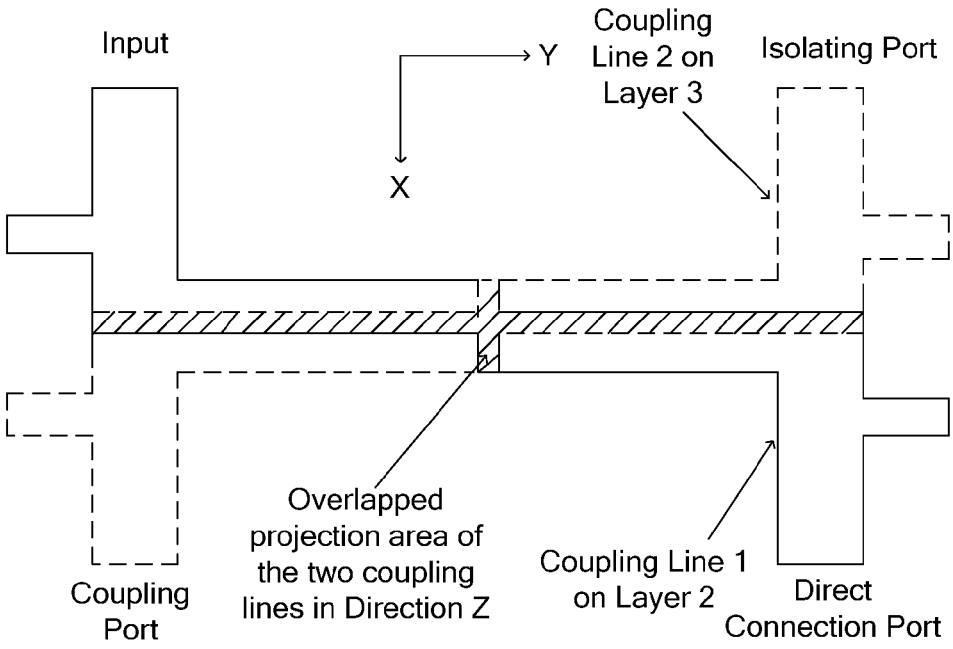
FIG. 11 is a top view in direction Z of the structure of a multilayered dielectric broad-side coupler.

FIG. 11 is a top view in direction Z of the two coupled broad-side coupling lines on a multilayered dielectric broad-side coupler. It is seen from FIG. 11: by setting the length of the coupling lines to a quarter wave length corresponding to the working band, the phase of output signal from the coupling port of the multilayered dielectric broad-side coupler can lead the phase of output signal from the direct connection port by 90°. In the topological structure of circuits in the various embodiments, since two fixed 45° or 90° phase shifters are cascaded between the two stages of couplers, for a signal input from Input1 or a signal input from Input2, there is 45° or 90° phase difference between the output signals from adjacent output ports in the entire feed network device. The coupling degree of the multilayered dielectric broad-side couplers in the first stage and the second stage can be adjusted by adjusting the overlapped projection area of the two crossed coupling lines between the second layer and the third layer in direction Z.

Since multilayered dielectric broad-side couplers are used and the two broad-side coupling lines are in symmetric structure (e.g., Z-shaped or step-shaped structure) and in X-shaped distribution in space roughly, the overlapped projection area in direction Z will not be changed even if relative deviation (caused by PCB processing error) exists between the two broad-side coupling lines; in that way, error in coupling degree caused by processing error can be avoided.

Since all of the multilayered dielectric broad-side couplers utilize the PCB material as the dielectric, the electrical performance parameters of the feed network device are improved; in addition, broad-side coupling further improves the electrical performance parameters of the feed network device, such as high isolation between input and output ports, less insertion loss, and good port standing wave characteristic, etc.; furthermore, the output signal has excellent power flatness and wide bandwidth. In addition, the size of the feed network device is reduced, and thereby the cost is reduced. Adverse effects of processing error to the coupling degree can be avoided, and the processing uniformity can be assured; both the welding work and the assembling work are easy and quick, and mass production can be carried out.

In the feed network device that provides equal-amplitude output or unequal-amplitude output in the present disclosure, the input ports are arranged on a side of the PCB and the output ports are arranged on another side of the PCB, and therefore are easy to install and service.

It is seen from above various embodiments, corresponding circuits can be designed on PCBs of the same size according to the requirement for equal-amplitude or unequal-amplitude output from the feed network device and the requirement for specific phase difference, so as to improve flexibility of the functionality of the entire feed network device, wherein:

If the system requires equal-amplitude outputs from the four output ports (Output1, Output2, Output3, and Output4) for either input signal (Input1 or Input2), it is required that the first stage of couplers be set as 3 dB multilayered dielectric broad-side couplers;

If the system requires that the output signals from two output ports be at the same amplitude, the output signals from the other two output ports be at the same amplitude, and the amplitudes of the output signals from the two sets of ports must have some difference to each other or have certain proportional relation with each other, it is required that the coupling degree of the two couplers in the first stage be adjusted by means of field emulation.

It is seen from above various embodiments, after the signal wave beam transmitted from the transmitter TX in the base station system enters the feed network device via the duplexer, it can be output at equal amplitude or unequal amplitude, and constant 45° or 90° phase difference exists between the signals output from adjacent output ports (i.e., beam shaping).

In the prior art, since the main line and branch lines of branch line directional coupler are arranged on surface of the PCB, with air as the dielectric at one side and PCB material as the dielectric at the other side, the ambient dielectric constant for the main line is different to the ambient dielectric constant for the branch lines, which cause poor electrical performance of the feed network device. In the various embodiments, all couplers of the feed network device are multilayered dielectric broad-side couplers arranged in the PCB, with PCB material as the dielectric; therefore, the dielectric is distributed evenly and has the same dielectric constant. Furthermore, since multilayered dielectric broad-side couplers are used in the feed network device in the various embodiments and the two broad-side coupling lines of a multilayered dielectric broad-side couplers are in symmetric structure (e.g., Z-shaped or step-shaped structure) and in X-shaped distribution in space roughly, the overlapped projection area of the multilayered broad-side coupling lines on the PCB surface of the feed network device will not be changed even if relative deviation (caused by PCB processing error) exists between the two broad-side coupling lines; in that way, error in coupling degree caused by processing error can be avoided. Therefore, the present disclosure can improve electrical performance of feed network device, antenna feeder subsystem, and base station system.

When a feed network device provided in the present disclosure is applied in a base station system in 3G mobile communication system, a input port of the feed network device is connected to a duplexer (a wave beam port), a output port is connected to a input port of a power divider; by shaping a wave beam, the feed network device can provide a plurality of different narrow beams to a antenna array, and thereby system capacity, spectrum utilization ratio, and receiver sensitivity are increased, base station power emission and system cost and reduced, and smooth network expansion is simplified.

In conclusion, the present disclosure implements a feed network device that is low in cost, easy to process and assemble, and has good electrical performance and small footprint; in addition, by adjusting the coupling degree of the couplers in the first stage in the design process, the entire feed network device can provide signals output at equal amplitude or unequal amplitude for any input signal, with a constant signal phase difference between the output ports such as 45° or 90°, and thereby perform wave beam shaping flexibly and meet different application demands for the system.

Those skilled in the art should recognize that various variations and modifications can be made without departing from the spirit and scope of the present disclosure. Therefore if these variations and modifications fall into the scope of the accompanying claims or its equalities, the present disclosure is intent to cover them.

What is claimed is:

1. A feed network device, comprising: two first stage couplers, two phase shifters, and two second stage couplers cascaded on a printed circuit board, wherein each first stage couplers and second stage couplers is a multilayered dielectric broad-side coupler, and the difference of phase between an output signal at the coupling port and an output signal at the direct connection port is 90° in each multilayered dielectric broad-side coupler, wherein each multilayered dielectric broad-side coupler in the first stage is a multilayered dielectric broad-side coupler that provides output signals at unequal amplitude, and each multilayered dielectric broad-side coupler in the second stage is a multilayered dielectric broad-side coupler that provides output signals at equal amplitude.

2. The feed network device according to claim 1, wherein each multilayered dielectric broad-side coupler is a multilayered dielectric broad-side coupler that provides output signals at equal amplitude.

3. The feed network device according to claim 1, wherein the two multilayered dielectric broad-side couplers in the first stage have different degrees of coupling.

4. The feed network device according to claim 1, wherein an input port of each multilayered dielectric broad-side coupler in the first stage is a signal input port, and the other input port is connected with a matched load resistance; two output ports of each multilayered dielectric broad-side coupler in the second stage are signal output ports.

5. The feed network device according to claim 1, wherein the two phase shifters are 45° phase shifters, wherein:

the coupling port of the first multilayered dielectric broad-side coupler in the first stage is connected to an input port of the first multilayered dielectric broad-side coupler in the second stage via a 45° phase shifter, the direct connection port of the first multilayered dielectric broad-side coupler in the first stage is connected directly to an input port of the second multilayered dielectric broad-side coupler in the second stage;

the coupling port of the second multilayered dielectric broad-side coupler in the first stage is connected to the other input port of the second multilayered dielectric broad-side coupler in the second stage via a 45° phase shifter, and the direct connection port of the second multilayered dielectric broad-side coupler in the first stage is connected directly to the other input port of the first multilayered dielectric broad-side coupler in the second stage.

6. The feed network device according to claim 1, wherein the two phase shifters are 90° phase shifters, the direct connection port of the first multilayered dielectric broad-side coupler in the first stage is connected to an input port of the first multilayered dielectric broad-side coupler in the second stage via a 90° phase shifter, and the coupling port of the first multilayered dielectric broad-side coupler in the first stage is directly connected to an input port of the second multilayered dielectric broad-side coupler in the second stage;

the direct connection port of the second multilayered dielectric broad-side coupler in the first stage is connected to the other input port of the first multilayered dielectric broad-side coupler in the second stage via a 90° phase shifter, and the coupling port of the second multilayered dielectric broad-side coupler in the first stage is directly connected to the other input port of the second multilayered dielectric broad-side coupler in the second stage.

7. The feed network device according to claim 1, wherein two broad-side coupling lines of each multilayered dielectric broad-side coupler are distributed in a cross manner, the two input ports are on one side of the multilayered dielectric broad-side coupler, and the two output ports are on the opposite side of the multilayered dielectric broad-side coupler.

8. The feed network device according to claim 1, wherein the printed circuit board comprises four layers, the two broad-side coupling lines of each multilayered dielectric broad-side coupler are arranged on two intermediate layers of the printed circuit board, the two signal input ports of the feed network device are arranged on one side of the printed circuit board, and the four signal output ports are arranged on the opposite side of the printed circuit board.

9. An antenna feeder subsystem, comprising a feed network device, a power divider, and an antenna array connected in sequence, wherein the feed network device comprises two first stage couplers, two phase shifters, and two second stage couplers cascaded on a printed circuit board, wherein each first stage couplers and second stage couplers is a multilayered dielectric broad-side coupler, and the difference of phase between an output signal at the coupling port and an output signal at the direct connection port is 90° in each multilayered dielectric broad-side coupler, wherein each multilayered dielectric broad-side coupler in the first stage is a multilayered dielectric broad-side coupler that provides output signals at unequal amplitude, and each multilayered dielectric broad-side coupler in the second stage is a multilayered dielectric broad-side coupler that provides output signals at equal amplitude.

10. The antenna feeder subsystem according to claim 9, wherein each multilayered dielectric broad-side coupler is a multilayered dielectric broad-side coupler that provides output signals at equal amplitude.

11. The antenna feeder subsystem according to claim 9, wherein the two multilayered dielectric broad-side couplers in the first stage have different degrees of coupling.

12. The antenna feeder subsystem according to claim 9, wherein an input port of each multilayered dielectric broad-side coupler in the first stage is a signal input port, and the other input port is connected with a matched load resistance; two output ports of each multilayered dielectric broad-side coupler in the second stage are signal output ports.

13. A base station system, comprising a duplexer and an antenna feeder subsystem connected to the duplexer, wherein, the antenna feeder subsystem comprises a feed network device, a power divider, and an antenna array connected in sequence, wherein the feed network device comprises two first stage couplers, two phase shifters, and two second stage couplers cascaded on a printed circuit board, wherein each first stage couplers and second stage couplers is a multilayered dielectric broad-side coupler, and the difference of phase between an output signal at the coupling port and an output signal at the direct connection port is 90° in each multilayered dielectric broad-side coupler, wherein each multilayered dielectric broad-side coupler in the first stage is a multilayered dielectric broad-side coupler that provides output signals at unequal amplitude, and each multilayered dielectric broad-side coupler in the second stage is a multilayered dielectric broad-side coupler that provides output signals at equal amplitude.

14. The base station system according to claim 13, wherein each multilayered dielectric broad-side coupler is a multilayered dielectric broad-side coupler that provides output signals at equal amplitude.

15. The base station system according to claim 13, wherein each multilayered dielectric broad-side coupler in the first stage is a multilayered dielectric broad-side coupler that provides output signals at unequal amplitude, and each multilayered dielectric broad-side coupler in the second stage is a multilayered dielectric broad-side coupler that provides output signals at equal amplitude.

16. The base station system according to claim 13, wherein the two multilayered dielectric broad-side couplers in the first stage have different degrees of coupling.

17. The base station system according to claim 13, wherein an input port of each multilayered dielectric broad-side coupler in the first stage is a signal input port, and the other input port is connected with a matched load resistance; two output ports of each multilayered dielectric broad-side coupler in the second stage are signal output ports.

* * * * *